US010159367B2

(12) United States Patent
Buck

(10) Patent No.: US 10,159,367 B2
(45) Date of Patent: Dec. 25, 2018

(54) BEVERAGE LID THAT ATTACHES TO FOOD CONTAINER

(71) Applicant: Ronald Mark Buck, Encinitas, CA (US)

(72) Inventor: Ronald Mark Buck, Encinitas, CA (US)

(73) Assignee: SNACKTOPS, INC, Carlsbad, CA (US)

( * ) Notice: Subject to any disclaimer, the term of this patent is extended or adjusted under 35 U.S.C. 154(b) by 266 days.

(21) Appl. No.: 14/986,701

(22) Filed: Jan. 3, 2016

(65) Prior Publication Data

US 2016/0128502 A1 May 12, 2016
US 2018/0235387 A9 Aug. 23, 2018

Related U.S. Application Data

(63) Continuation of application No. 14/824,900, filed on Aug. 12, 2015, which is a continuation-in-part of (Continued)

(51) Int. Cl.
*A47G 19/22* (2006.01)
*A47G 21/18* (2006.01)
(Continued)

(52) U.S. Cl.
CPC ..... *A47G 19/2272* (2013.01); *A47G 21/18* (2013.01); *A47G 21/187* (2013.01);
(Continued)

(58) Field of Classification Search
CPC .. A47G 19/2272; A47G 21/18; A47G 21/187; B65D 43/02; B65D 43/0212;
(Continued)

(56) References Cited

U.S. PATENT DOCUMENTS 590,374 A 9/1897 Osburn
1,223,933 A 4/1917 Carr
(Continued)

OTHER PUBLICATIONS

International Preliminary Report on Patentability dated Jul. 25, 2017 in PCT/US2016/013116 (7 pages).

*Primary Examiner* — James N Smalley
*Assistant Examiner* — Madison L Poos
(74) *Attorney, Agent, or Firm* — Manuel de la Cerra

(57) ABSTRACT

A container lid is disclosed that accepts a snap-on container. The lid includes a continuous outer coupling trough for attachment to the open top of a beverage container where the trough circumscribes a footprint of the container lid. A straw-hole planar surface is disposed within the footprint, the straw-hole planar surface is adjacent to the outer coupling trough and a hole for drinking a liquid in the container extends through the straw-hole planar surface. A riser wall extends away from the straw-hole planar surface and defines a first planar surface above the straw-hole planar surface. A sip hole extends through the first planar surface. A food container coupling wall connects to the first planar surface and extends from the first planar surface to a position lower than the first planar surface and a food container coupling bottom connected to the food container coupling wall.

8 Claims, 13 Drawing Sheets

Related U.S. Application Data application No. 29/500,266, filed on Aug. 22, 2014, now Pat. No. Des. 726,477, which is a continuation-in-part of application No. 13/680,011, filed on Nov. 17, 2012, now Pat. No. 9,622,605, which is a continuation-in-part of application No. 13/360,707, filed on Jan. 28, 2012, now Pat. No. 8,381,935, which is a continuation-in-part of application No. 13/226,346, filed on Sep. 6, 2011, now Pat. No. 8,596,491.

(60) Provisional application No. 62/105,256, filed on Jan. 20, 2015.

(51) Int. Cl.

| | |
|---|---|
| ***B65D 43/02*** | (2006.01) |
| ***B65D 43/16*** | (2006.01) |
| ***B65D 47/32*** | (2006.01) |
| ***B65D 51/18*** | (2006.01) |
| ***B65D 81/32*** | (2006.01) |

(52) U.S. Cl.

CPC ..... *B65D 43/02* (2013.01); *B65D 43/0212* (2013.01); *B65D 43/16* (2013.01); *B65D 47/32* (2013.01); *B65D 51/18* (2013.01); *B65D 81/3205* (2013.01); *B65D 2251/009* (2013.01); *B65D 2251/0021* (2013.01); *B65D 2251/0028* (2013.01); *B65D 2251/0081* (2013.01); *B65D 2543/00046* (2013.01)

(58) Field of Classification Search

CPC ..... B65D 43/16; B65D 47/32; B65D 51/18; B65D 77/20; B65D 81/3205; B65D 2251/0021; B65D 2251/0028; B65D 2251/0081; B65D 2251/009; B65D 2543/00046

USPC ..... 220/703, 705, 709, 710, 711, 713

See application file for complete search history.

(56) References Cited

U.S. PATENT DOCUMENTS

| | | | | |
|---|---|---|---|---|
| 2,279,396 | A | 5/1941 | Hanson, Jr. | |
| D188,103 | S | 6/1960 | Scofield | |
| 3,568,870 | A | 3/1971 | Elston | |
| D344,131 | S | 2/1994 | Hubbell | |
| 5,568,006 | A | 10/1996 | Luff | |
| D537,892 | S | 3/2007 | Moses | |
| D615,645 | S | 5/2010 | Brigatti | |
| D625,957 | S | 10/2010 | Minns | |
| D715,083 | S | 10/2014 | Miracle | |
| 2003/0089714 | A1* | 5/2003 | Dart | B65D 43/0212 220/254.3 |
| 2007/0267425 | A1 | 11/2007 | Gill | |
| 2013/0068854 | A1 | 3/2013 | Miracle | |
| 2013/0119065 | A1* | 5/2013 | Buck | A47G 19/2205 220/523 |

* cited by examiner

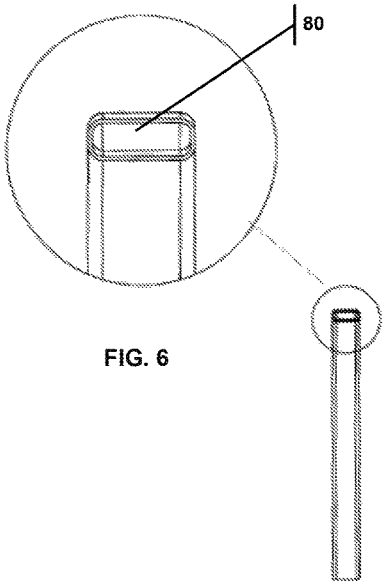
FIG. 6
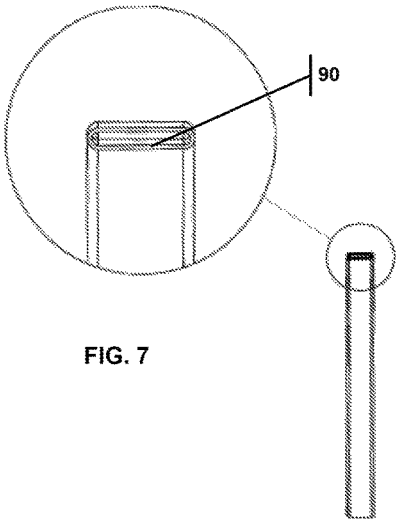
FIG. 7
FIG. 8
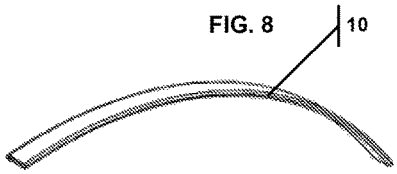
FIG. 9
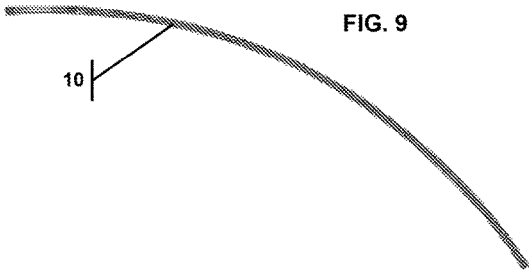

Analysis of New Invention: Flow Limiting Straw

Description of System

The system is am extruded and or manufactured plastic member that comprises a specific geometry range to limit flow as the customer enjoys their beverage. This system has specific interest in transferring hot liquids (coffee or tea) and acts as a preventative measure to alleviate scalding of the interior of the customer's mouth.

Definition of System & Variables

The system is defined by Figure 1.

Definition of variables:

1. L- Width Of Flow Cross Section
2. D- Thickness of Flow Cross Section & Diameter of Ends
3. H-Overall Height of System
4. V - Velocity
5. OH – System Rating Number / System Head

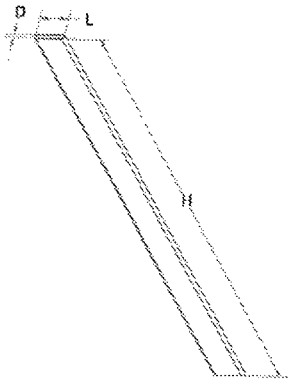

Figure 1

Givens & Constants:

1. Fluid – Water @ 180 Degrees F
2. Material Roughness- .00006 in
3. Kinematic Viscosity - .00000383
4. Human induced Pressure Change – 5 psi
5. Gravimetric Acceleration – 32.2 ft/s^2 or 386 in/s^2
6. Fluid Density - .035 lbs/in^3
7. Friction Factor – Extracted From Moody Diaphragm (Figure 2)

FIGURE 12A

Analysis

| | System 1 | System 2 | System 3 | System 4 |
|---|---|---|---|---|
| Gravity (in/s^2) | 386.4 | 386.4 | 386.4 | 386.4 |
| L (Inches) | 0.25 | 0.41 | 0.41 | 0.44 |
| D (Inches) | 0.02 | 0.03 | 0.03 | 0.05 |
| H (Inches) | 11 | 10.25 | 8.5 | 8.5 |
| Roughness (in) | 0.00006 | 0.00006 | 0.00006 | 0.00006 |
| Kinematic Viscosity | 0.00000383 | 0.00000383 | 0.00000383 | 0.00000383 |
| Cross Section Area (in^2) | 0.0049141 | 0.012106725 | 0.012106725 | 0.021463125 |
| Hydraulic Diameter (in) | 0.037596878 | 0.056690704 | 0.056690704 | 0.091619978 |
| Velocity (in/s) | 9.628810934 | 24.54045639 | 24.54045639 | 25.00787876 |
| Relative Roughness | 0.001595877 | 0.001058375 | 0.001058375 | 0.000654879 |
| Reynolds Number | 94520.42675 | 363241.7094 | 363241.7094 | 598230.1022 |
| Friction Factor | 0.019 | 0.02 | 0.02 | 0.018 |
| OH (in) | 0.666918405 | 2.817994679 | 2.336873636 | 1.351412235 |
| OH (Ft) | 0.055576534 | 0.23483289 | 0.19473947 | 0.112617686 |

OH Equation=( Friction Factor X (L/ Hydraulic Diameter))*((Velocity^2)/(2* Gravity))

FIGURE 12B

FIGURE 13C
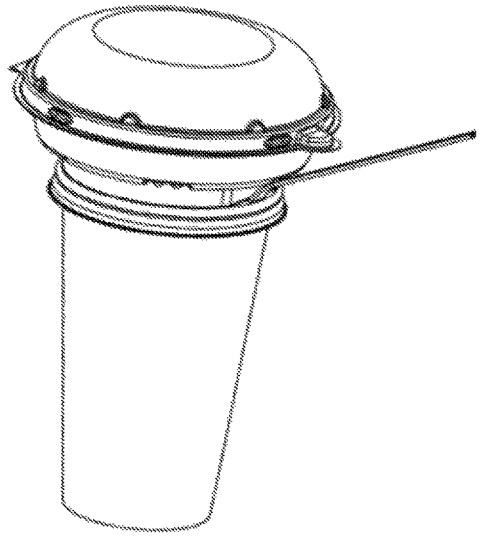
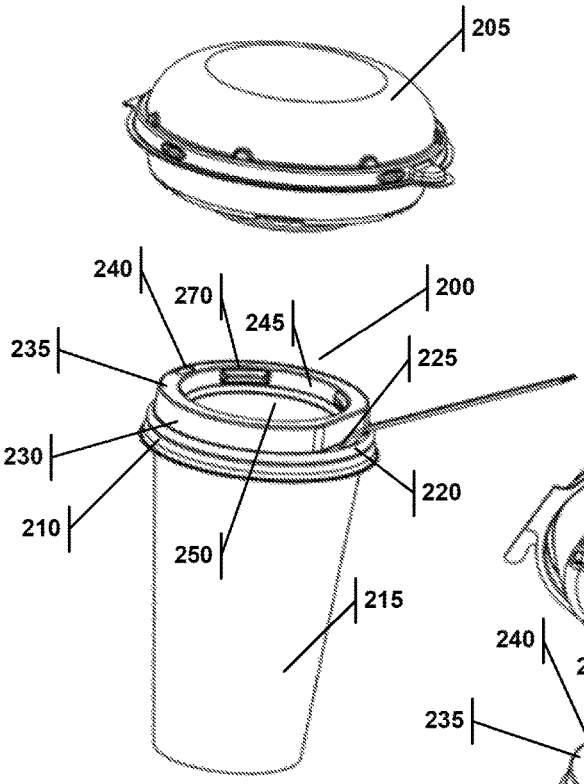
FIGURE 13D
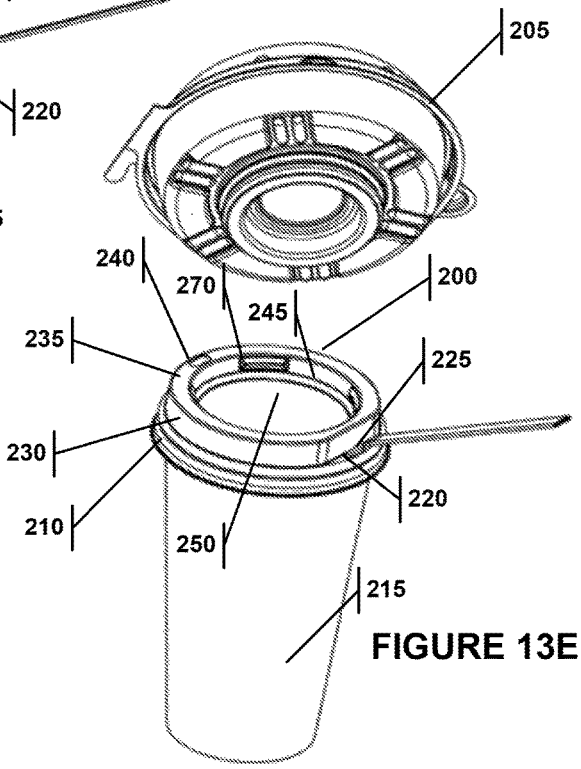
FIGURE 13E

BEVERAGE LID THAT ATTACHES TO FOOD CONTAINER

1.0 TECHNICAL FIELD

The present invention relates to drinking straws.

2.0 RELATED APPLICATIONS

This application is also related to U.S. Pat. No. 8,596,491 entitled "CUP LID WITH INTEGRATED CONTAINER" issued on Dec. 3, 2013; U.S. Pat. No. 8,695,845 entitled "TOP MOUNTING CAN CONTAINER" issued on Apr. 15, 2014; U.S. Pat. No. 8,381,935 entitled "CUP LID WITH INTEGRATED CONTAINER" issued on Feb. 26, 2013; U.S. Pat. No. 8,714,393 entitled "CUP LID WITH INTEGRATED CONTAINER" issued on May 6, 2014; U.S. Pat. No. 8,590,730 entitled "TOP MOUNTING CAN CONTAINER" issued on Nov. 26, 2013; U.S. Pat. No. 8,708,181 entitled "LID WITH INTEGRATED CONTAINER" issued on Apr. 29, 2014; U.S. Pat. No. 8,701,914 entitled "TWO-PART RECYCLABLE CUP" issued on Apr. 22, 2014; U.S. patent application Ser. No. 13/412,602 entitled "TOP MOUNTING BOTTLE CONTAINER" filed on Mar. 5, 2012; U.S. patent application Ser. No. 13/680,011 entitled "CUP LID WITH INTEGRATED CONTAINER" filed on Nov. 17, 2012; U.S. patent application Ser. No. 13/680,049 entitled "CUP LID WITH INTEGRATED CONTAINER" filed on Nov. 17, 2012; U.S. patent application Ser. No. 13/733,153 entitled "CUP LID WITH INTEGRATED CONTAINER" filed on Jan. 3, 2013; U.S. patent application Ser. No. 14/263,993 entitled "LID WITH INTEGRATED CONTAINER" filed on Apr. 28, 2014; U.S. patent application Ser. No. 14/269,016 entitled "A CONTAINER LID WITH ONE OR MORE CAVITIES" filed on May 2, 2014; U.S. patent application Ser. No. 14/274,576 entitled "A CONTAINER LID WITH A FOOD COMPARTMENT AND A SIP-HOLE" filed on May 9, 2014; U.S. patent application Ser. No. 14/313,907 entitled "A CONTAINER LID SYSTEM WITH A LID PORTION AND FOOD CONTAINER PORTION" filed on Jun. 24, 2014; U.S. Patent Application Ser. 62/005,862 entitled "A CONTAINER LID SYSTEM WITH A LID PORTION AND FOOD CONTAINER PORTION" filed on May 30, 2014; U.S. Patent Application 62/038,199 entitled "A CONTAINER LID SYSTEM WITH TAMPER INDICATOR" filed on Aug. 15, 2014; U.S. patent application Ser. No. 29/500,266 entitled "BENDABLE DRINKING STRAW" filed on Aug. 22, 2014; and U.S. Patent Application 62/105,256 entitled "BENDABLE SAFETY STRAW AND LIDS WITH FOOD COMPARTMENT" filed on Jan. 20, 2015; all of which are by the same inventor of the present application. Each of these applications is incorporated herein by reference.

3.0 BACKGROUND

The increased popularity of fast-food establishments, coupled with the popularity of consumption of food and beverages on-the-go, have led to the need for more convenient and safer takeout packaging.

Currently, a consumer wishing to drink from a takeout beverage container has two standard options: sipping the beverage through a sip hole in the lid of the beverage container, as is common for hot drinks such as coffee; or sucking the beverage through a straw placed into the beverage container, as is common for drinks consumed cold, such as sodas. Sip holes, typically used for hot beverages, require the consumer to take small sips to avoid scalding. While many consumers would prefer a controlled or regulated delivery of their hot beverage, standard straws do not allow for the liquid to cool to a comfortable temperature before reaching the consumer's mouth and thus have the potential to cause burns. Both straws and sip holes can be hazardous when the consumer is engaged in an activity, such as driving or walking, which requires maintaining his or her eyes forward to watch the path ahead, and which may involve sudden stops. The consumer may have to look down and away from the road while drinking from a straw or may have his or her forward vision obstructed by the beverage container while tipping it back to drink via a sip hole. Straws are also potentially dangerous if the consumer's head happens to decelerate quickly while drinking, for example when braking unexpectedly during a drive. In that case, the straw may stab the consumer in the roof of her or his mouth. While some straws incorporate a flexible portion to allow the consumer to keep his or her eyes forward, they do not eliminate this risk of stabbing, and further must be sized particularly for each height of beverage container.

Existing takeout beverage and food containers are also inconvenient, requiring the consumer to set aside a sandwich to take a drink, for example; or, in the case of a beverage container with a lid that accepts a snap-on food container, the food container must be decoupled in order for the consumer to sip a hot drink through a sip hole.

What is therefore needed is a straw that overcomes these drawbacks and fosters convenient on-the-go drinking.

4.0 SUMMARY

The present invention provides an elegant solution to the needs described above and provides numerous additional benefits and advantages, as will be apparent to persons of skill in the art.

One aspect provides a container lid that can be coupled to a food container, wherein the lid includes a continuous outer coupling trough for attachment to the open top of a beverage container, where the trough circumscribes a footprint of the container lid. A straw-hole planar surface is disposed within the footprint; the straw-hole planar surface is adjacent to the outer coupling trough, and a hole for drinking a liquid in the container extends through the straw-hole planar surface. A riser wall extends away from the straw-hole planar surface and defines a first planar surface above the straw-hole planar surface. A sip hole extends through the first planar surface. A food container coupling wall connects to the first planar surface and extends from the first planar surface to a position lower than the first planar surface and a food container coupling bottom connected to the food container coupling wall.

The foregoing summary is illustrative only and is not meant to be exhaustive. Other aspects, objects, and advantages of this invention will be apparent to those of skill in the art upon reviewing the drawings, the disclosure, and the appended claims.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. It will be understood that certain components and details may not appear in the figures to assist in more clearly describing the invention.

FIG. 6 is an embodiment of the straw with a large opening.

FIG. 7 is an embodiment of the straw with a narrow opening.

FIG. 8 is an isometric view of the straw of FIG. 1.

FIG. 9 is a side view of the straw of FIG. 1.

FIG. 12A depicts the general parameters for flow analysis of a novel straw.

FIG. 12B depicts the flow analysis of four straw configurations.

FIG. 13C is an isometric view of the beverage container/lid complex of FIG. 13A.

FIG. 13D is an isometric view of the beverage container/lid complex of FIG. 13A with the food container detached from the lid of the beverage container.

FIG. 13E is an isometric view of the beverage container/lid complex of FIG. 13A with the food container detached from the lid beverage container and rotated to show the mating surfaces.

6.0 DETAILED DESCRIPTION

Following is a non-limiting written description of example embodiments illustrating various aspects of the invention. These examples are provided to enable a person of ordinary skill in the art to practice the full scope of the invention without having to engage in an undue amount of experimentation. As will be apparent to persons skilled in the art, further modifications and adaptations can be made without departing from the spirit and scope of the invention, which is limited only by the claims. In the following description, numerous specific details are set forth in order to provide a thorough understanding of the present invention. Particular example embodiments of the present invention may be implemented without some or all of these features or specific details. In other instances, components well known to persons of skill in the art have not been described in detail in order not to obscure unnecessarily the present invention.

Figure 1:
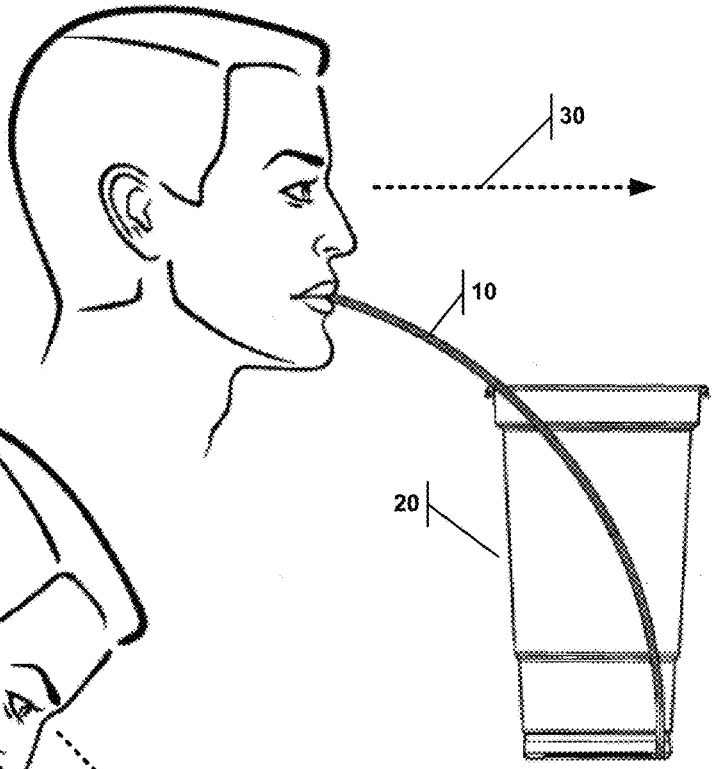
FIG. 1 illustrates a consumer using a novel straw, without diverting the consumer's gaze.
Figure 2:
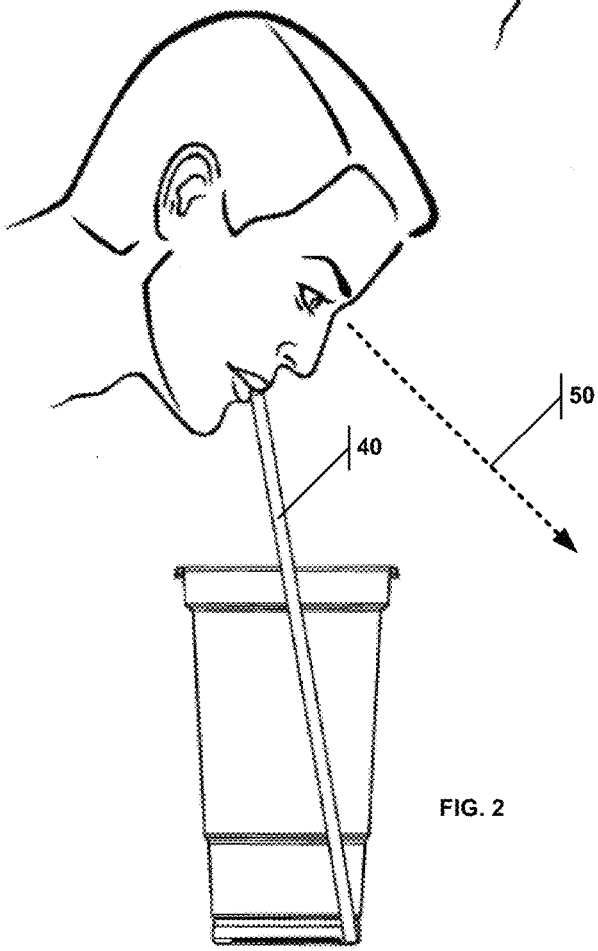
FIG. 2 illustrates a consumer using a conventional straw with the consumer's gaze diverted.

FIG. 1 illustrates the straw 10 used in a beverage container 20. The straw is similar to the one disclosed in U.S. patent application Ser. No. 29/500,266 entitled "BENDABLE DRINKING STRAW" filed on Aug. 22, 2014, which is by the same inventor of the present application and is incorporated herein by reference. The straw 10 may optionally be pre-shaped with an arc shape, and is flexible as described in more detail with reference to FIG. 10. The straw 10 may also be semi-rigid such that it returns to its original shape when it is not under a bending force. The straw 10 may be made of a compliant material such as plastic or composite to allow it to reversibly deflect, as described in more detail with reference to FIG. 10. Because the straw 10 may be pre-formed with an arc shape, the consumer can drink from the straw from a natural horizontal position while keeping her or his gaze 30 forward. This is important when the consumer's gaze cannot be diverted: for example, when the consumer is driving a vehicle and would like to take a sip through the straw without looking away from the road ahead. As shown in FIG. 2, with a conventional straw 40, the consumer's gaze 50 is diverted when drinking.

Previous straw designs addressed this problem with a short section of the straw that was bendable with an accordion-like structure. The portion of the straw on either end of the accordion-like structure was straight, and bending the accordion-like structure could create a 90-degree turn such that the user would access the end of the straw in the horizontal position. But as discussed below, when these accordion-like bendable straws are used with a top-mounted snap-on food container that may be larger than the beverage container lid, the straw must be sized in relation to the height of each particular type of beverage container, thereby reducing its utility.

Figures 3A, 3B, 3C:
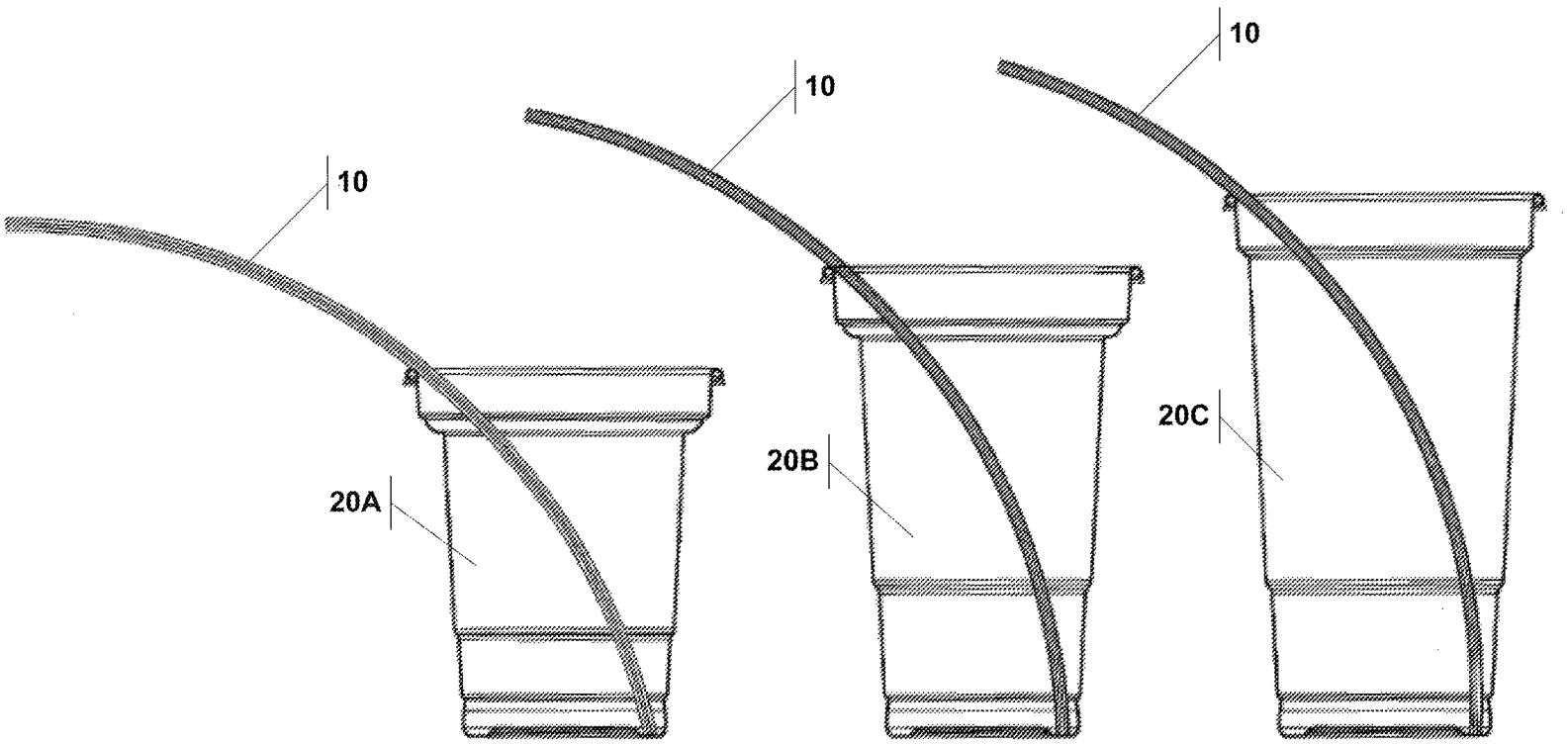
FIG. 3A shows the straw of FIG. 1 used with a short beverage container.
FIG. 3B shows the straw of FIG. 1 used with a beverage container that is taller than the beverage container of FIG. 3A.
FIG. 3C shows the straw of FIG. 1 used with a beverage container that is taller than the beverage container of FIG. 3B.
Figure 4:
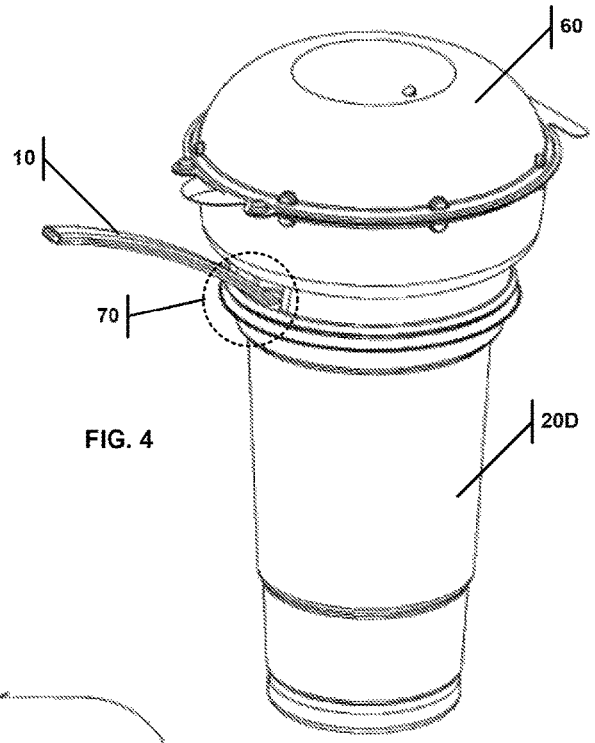
FIG. 4 is an isometric view of the straw of FIG. 1 used with a beverage container that has a food compartment on top.
Figure 5:
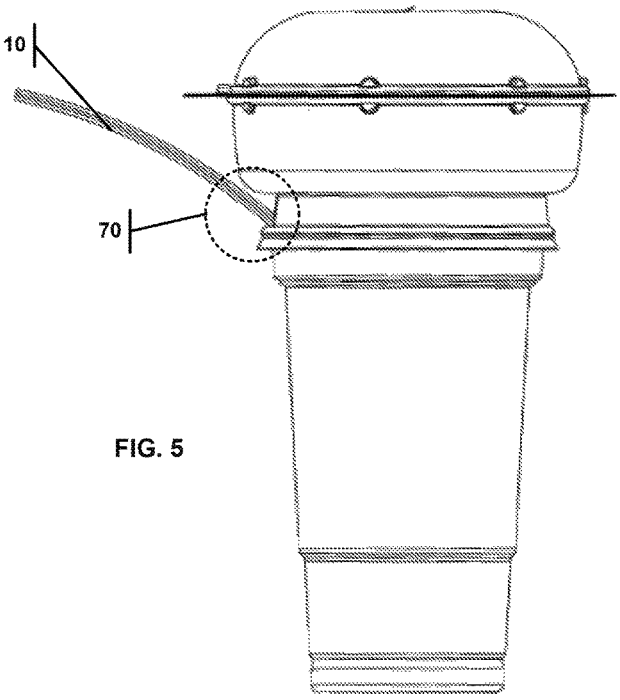
FIG. 5 is a side view of the straw of FIG. 1 used with a beverage container that has a food compartment on top.

FIGS. 3A, 3B and 3C illustrate the same straw 10 placed into three beverage containers of different depths 20A, 20B, 20C. The straw 10 exits the beverage container with about the same amount of vertical clearance. This takes on more importance when the beverage container only has limited vertical clearance. For example, in FIG. 4, the beverage container 20D has a food container 60 placed on top it. Such a food container is disclosed in the applications listed at the beginning of this application, the disclosures of which are fully incorporated herein by reference. But as shown at position 70, the food container 60 restricts the amount of vertical clearance of a straw 10. A conventional accordion-like bendable straw would need to be specifically manufactured for the precise depth of the container 20D. If the food container 60 were placed on a shorter beverage container (for example, container 20A of FIG. 3A), yet another straw would need to be manufactured that was shorter. Because of the bendable characteristics of the straw 10, which may optionally be arc-shaped, (shown in more detail in FIGS.

3A, 3B and 3C), a single straw can be used with various heights of beverage containers.

FIGS. 6 and 7 illustrate two cross-sectional shapes of the straw 10, with FIG. 6 having a larger opening 80 for thicker beverages such as milkshakes, and with FIG. 7 having a narrower opening 90 for hot beverages such as coffee. It would be apparent that other cross-sectional shapes are possible.

FIG. 8 is an isometric view of the straw 10 intended to show the arc shape. FIG. 9 is a side view showing the arc shape. In the embodiments shown, the straw has more than a 20-degree arc and is approximately 12 inches long. It would be apparent that other arc angles and lengths are possible.

Figure 10:
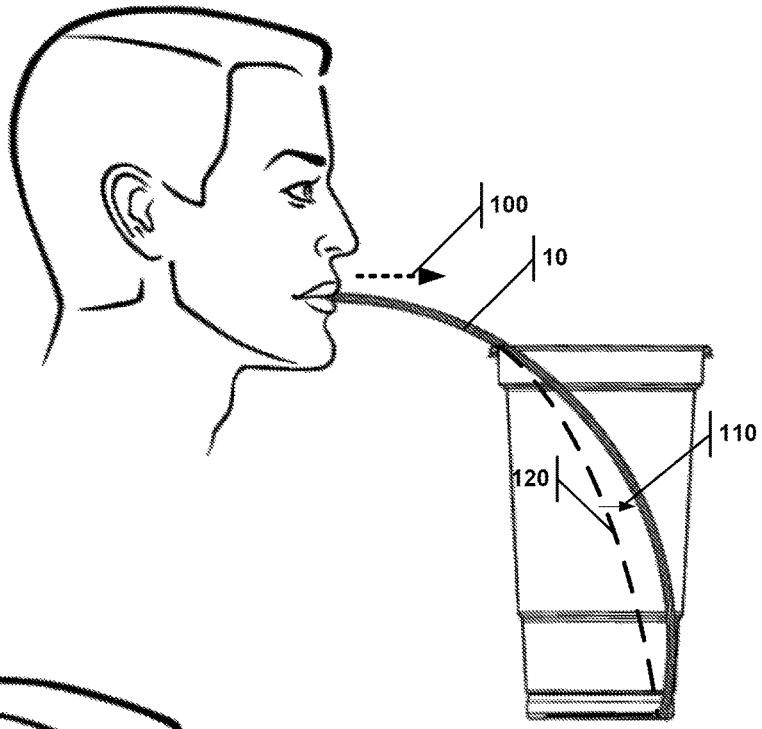
FIG. 10 illustrates the straw of FIG. 1 deforming into the beverage container.
Figure 11:
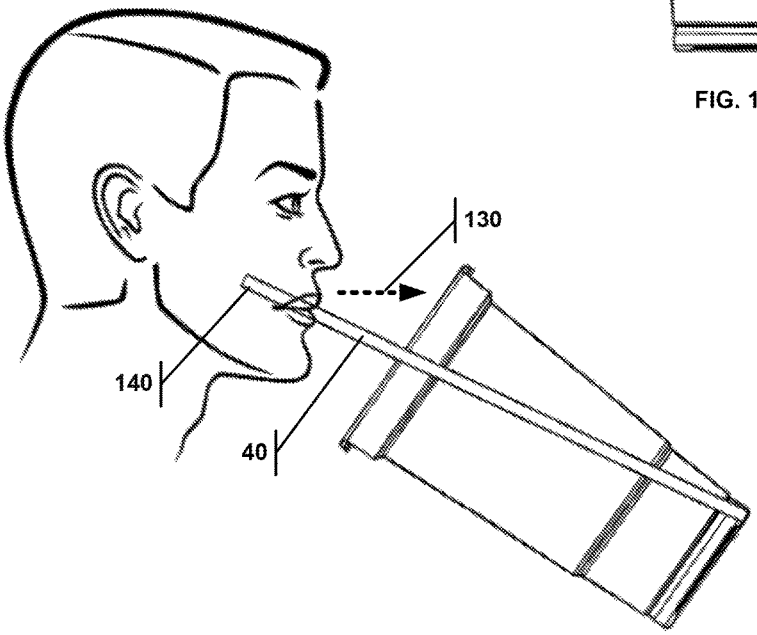
FIG. 11 illustrates how a conventional straw can stab the inside of a consumer's mouth.

In addition to the safety feature of allowing a consumer to drink in a natural horizontal position without diverting her or his gaze, the straw also is compliant so as to minimize the stabbing effect that is common with a conventional straw. FIG. 10 illustrates a consumer drinking from the straw 10 even when experiencing a force that propels the consumer's head forward in the direction of arrow 100. The straw 10 bendably deforms to position 110 from position 120. A conventional straw 40, shown in FIG. 11, would stab the consumer in the same situation. If, for example, a consumer was driving and held the beverage container in an orientation to maintain a forward gaze as in FIG. 11, and that consumer experienced a force such as hard braking that propelled the consumer's head forward in the direction of arrow 130, the straw 40 would not bend and would stab the inner portion of the consumer's mouth 140. Also, when the straw 40 bends, the cross-sectional area of the straw would collapse or crimp. The straw 10 is constructed such that the amount of force necessary to bend the straw does not cause discomfort to the user's mouth. In one embodiment, the amount of bending force necessary is between 0.02 N and 0.2 N. The straw 10 may be made more rigid, but the bending force would then also increase, possibly causing discomfort to the user's mouth.

A further feature of the straw concerns its ability to regulate or cool hot liquids during use to prevent burns. FIGS. 12A-12F illustrate a straight and bendable straw 10 used in a beverage container. The bendable drinking straw 10 is designed such that it can bend at least 180 degrees as shown in FIGS. 12D and 12F. The straw may also be optionally pre-formed in an arc shape.

Currently, hot liquids are delivered from a beverage container to the consumer via a sip hole that allows a user to tip the container and sip the hot liquid. It is the sipping that allows the liquid to cool, preventing scalding. Because the bendable straw can be used for hot beverages, it is helpful that the length and internal surface area of the straw allows the liquid to cool when it travels from the beverage container to the consumer's mouth. Conventional circular straws (by circular, it is meant the cross section is circular) do not allow for safely bending or deflecting off a top mounted food container, nor do they sufficiently regulate or cool a hot liquid. For this reason, consumers do not use a conventional circular straw for consuming hot beverages. Rather, the bendable straw disclosed herein may be used to have a properly sized cross-sectional area and length such that the amount of liquid entering the consumer's mouth is properly regulated or cooled, and therefore will not scald the user. This is especially helpful when the user is performing some other task while consuming the beverage. For example, a user who is driving would prefer to use a straw to consume the hot beverage such that his or her gaze is not diverted or obstructed by having to tilt the beverage container to access the liquid from the sip hole.

Figure 12C:
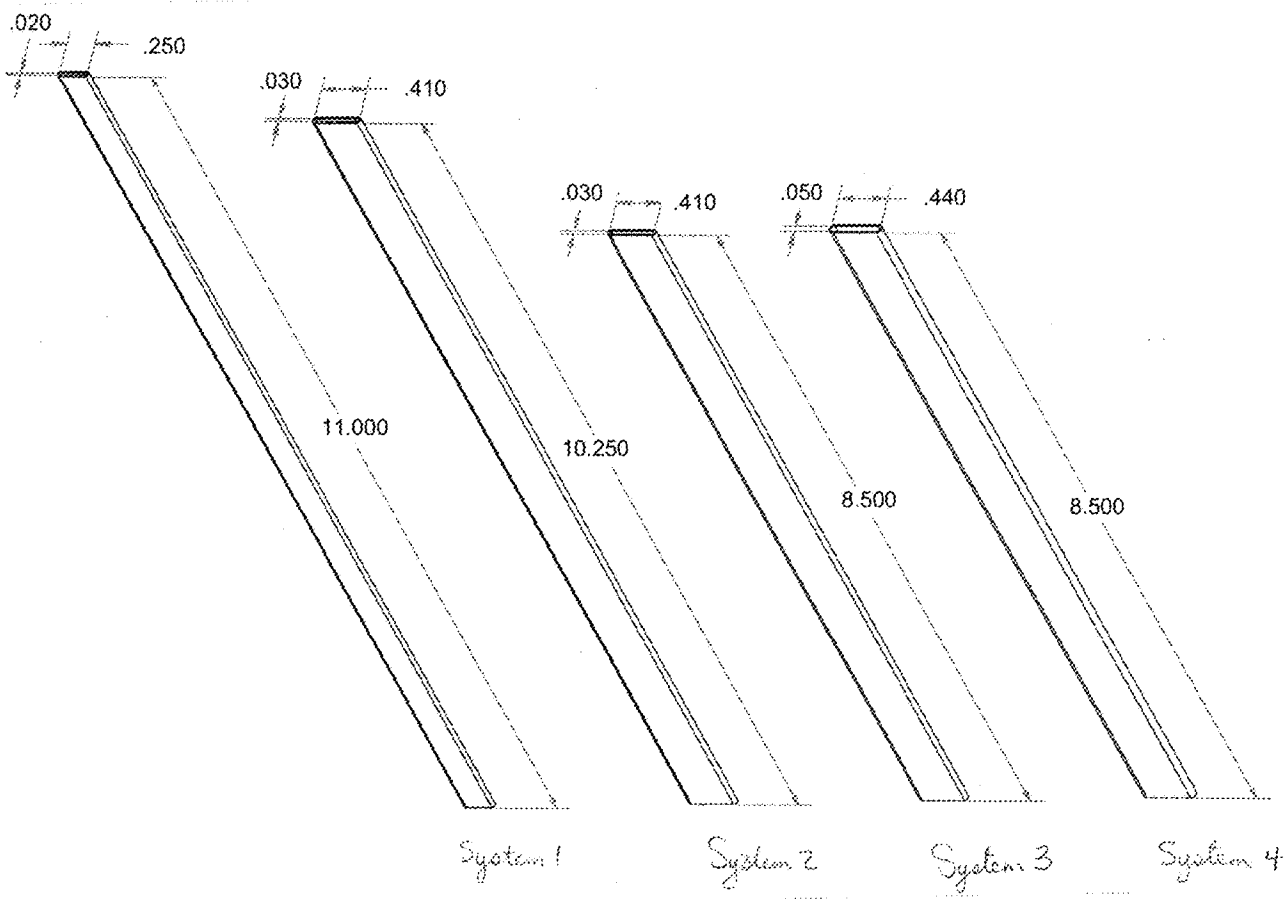
FIG. 12C is an isometric view of the straws of FIG. 12B.
Figure 12D:
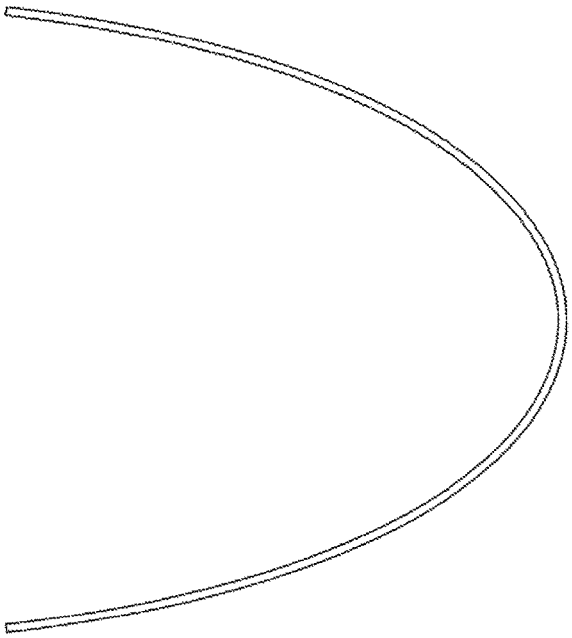
FIG. 12D is a side illustration of any of the straws of FIG. 12B in bending.

FIGS. 12A and 12B depict the flow analysis of four bendable straw configurations shown in FIG. 12C. The OH parameter (or the system rating number) is a qualitative measure of the amount of head caused by the straw and is calculated by the following equation:

$$OH=(\text{Friction Factor } X(L/\text{Hydraulic Diameter}))\times((\text{Velocity}\hat{}2)/(2*\text{Gravimetric Acceleration}))$$

Figure 12E:
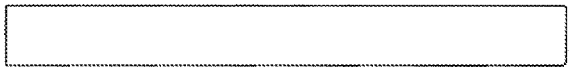
FIG. 12E is a front illustration of any of the straws of FIG. 12B in bending.
Figure 12F:
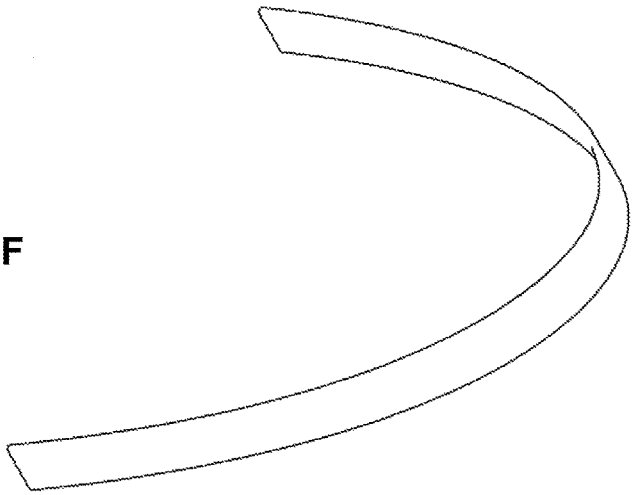
FIG. 12F is an isometric illustration of any of the straws of FIG. 12B in bending.

Each of these parameters is calculated and presented in FIG. 12B. The higher OH parameter, the more the straw is able to dissipate heat so as to reduce the temperature of the beverage as it moves through the straw. Another factor, shown in FIG. 12B, is the cross-sectional area and the velocity, the product of which is the volume of liquid delivered to the user. System 1 has a low OH, meaning that the straw allows less heat to escape from the liquid and the volume of liquid delivered to the user is about 0.0473 in^3/s. So while the straw allows less heat to escape from the liquid, the amount of liquid actually delivered is very small and reduces the possibility of scalding. A user may not prefer such low volume delivery. System 4 has a higher OH, meaning that the straw will allow more cooling, and the volume of liquid delivered to the user is much higher (10×) at about 0.537 in^3/s. While the user would like the additional volume, the OH value suggests that the liquid delivered may be too hot. The combination of high volume and high temperature runs the risk of scalding the user. Systems 2 and 3 have OH values of 0.23 and 0.19 inches respectively, with a volume delivery of 0.297 in^3/s. This combination of OH value and volume is the "sweet spot" where a user is delivered a pleasant amount of warm beverage while reducing the possibility of scalding. The optimal straw design is therefore shown by systems 2 and 3, with the dimensions provided in FIGS. 12A-12C. It would be apparent that the various parameters could be varied to reach an optimal volume/temperature profile for the straw without departing from the spirit of this invention. Those parameters may include but are not limited to the physical dimensions of the straw, the straw material, and the roughness of the straw. (A straw that has more internal roughness would increase the OH and reduce the temperature). Further, the dimensions may be chosen such that the straw can easily bend without causing the straw to collapse and thereby unreasonably restrict flow. The bending of the straws (systems 1-4) is shown in FIGS. 12D-12F.

FIGS. 13A-13I illustrate a lid 200 for a beverage container 215 that can be detachably connected to a food container 205. A bendable straw, as discussed with reference to FIGS. 12A-12F, may be inserted into a punch-out straw hole 225. A lid 200 has a continuous outer coupling trough 210 for attachment to the open top of the beverage container 215. The lid 200 also has a straw-hole planar surface 220 that is adjacent to the outer coupling trough 210. A straw hole 225 for drinking the liquid in the container extends through the straw-hole planar surface 220. A riser wall 230 extends away from the straw-hole planar surface 220 and defines a first planar surface 235 above the straw-hole planar surface 220. A sip hole 240 for drinking the liquid also extends through the first planar surface 235. To connect the lid 200 to the food container 205, the lid 200 may have a food container coupling wall 245 connected to the first planar surface 235 that extends down from the first planar surface 235 to a position lower than the first planar surface 235. The food container coupling wall 245 may also include a pressure structure 270 that places pressure against the food container 205 when a food container 205 is coupled to the lid 200. The pressure exerted by the pressure structure 270 is selected so as to allow the secure coupling of the food container 205 to the lid 200, and allow the decoupling of the food container 205 from the lid 200. The lid 200 may also have a vent hole 275 to relieve pressure buildup caused by hot beverages.

A food container coupling bottom 250 is connected to the food container coupling wall. The straw hole planar surface 220 may also have a straw hole cover 255 and a hinge 260, wherein the straw hole cover rotates about the hinge and exposes the straw hole 225 when a straw is punched through the straw hole 225. To prevent the straw hole cover 255 from inadvertently opening, it may have a tick 265 that connects it to the straw hole planar surface 220. The straw hole 225 may have a substantially rectangular shape with rounded corners 280, which would accommodate the straw 10 disclosed above.

Figure 13A:
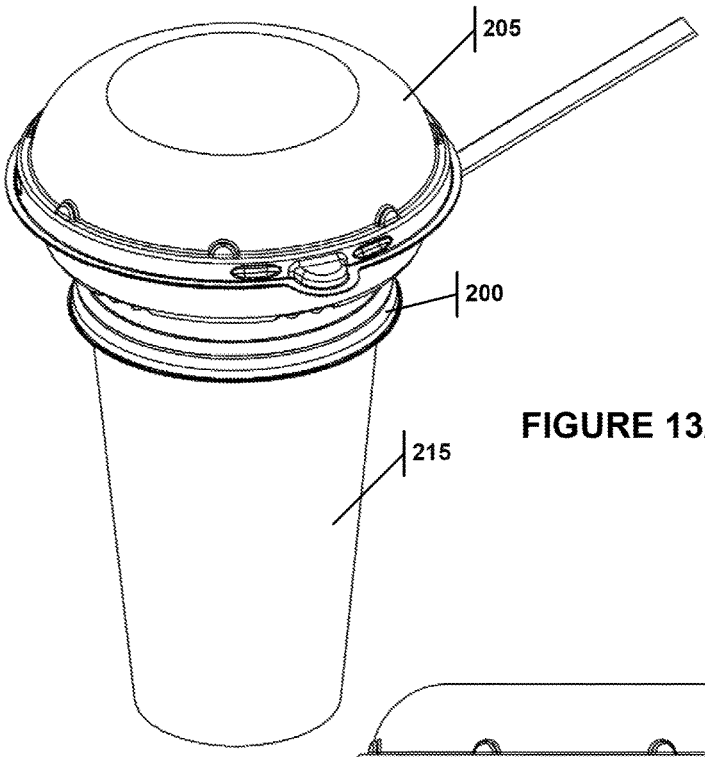
FIG. 13A is an isometric view of a beverage container with a lid that has a food container snapped or coupled to the lid, with the straw of FIG. 1.
Figure 13B:
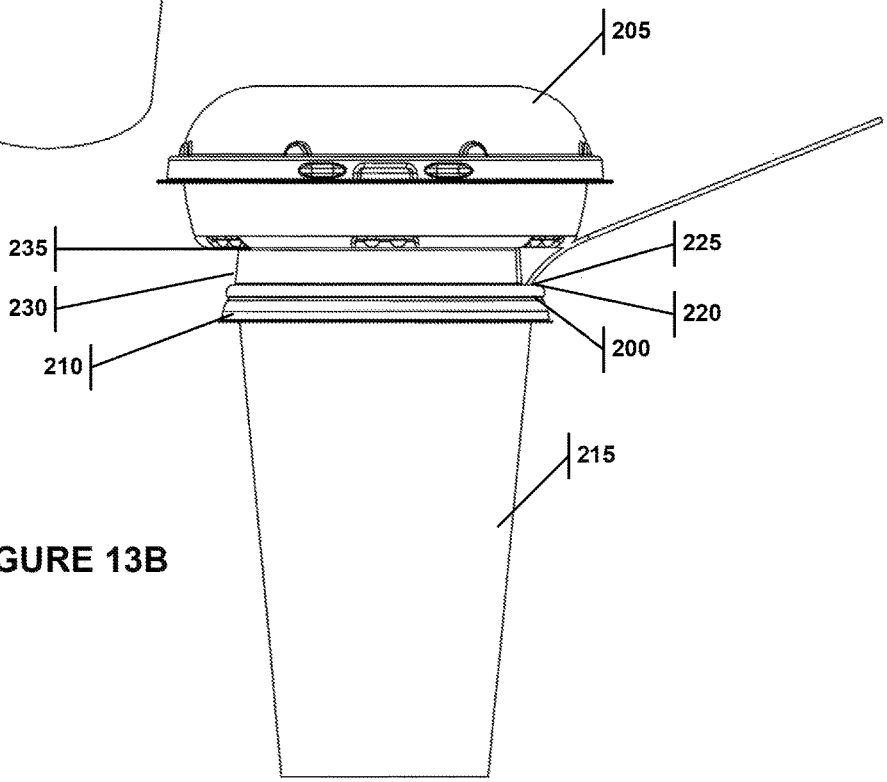
FIG. 13B is a side view of the beverage container/lid complex of FIG. 13A.
Figure 13F:
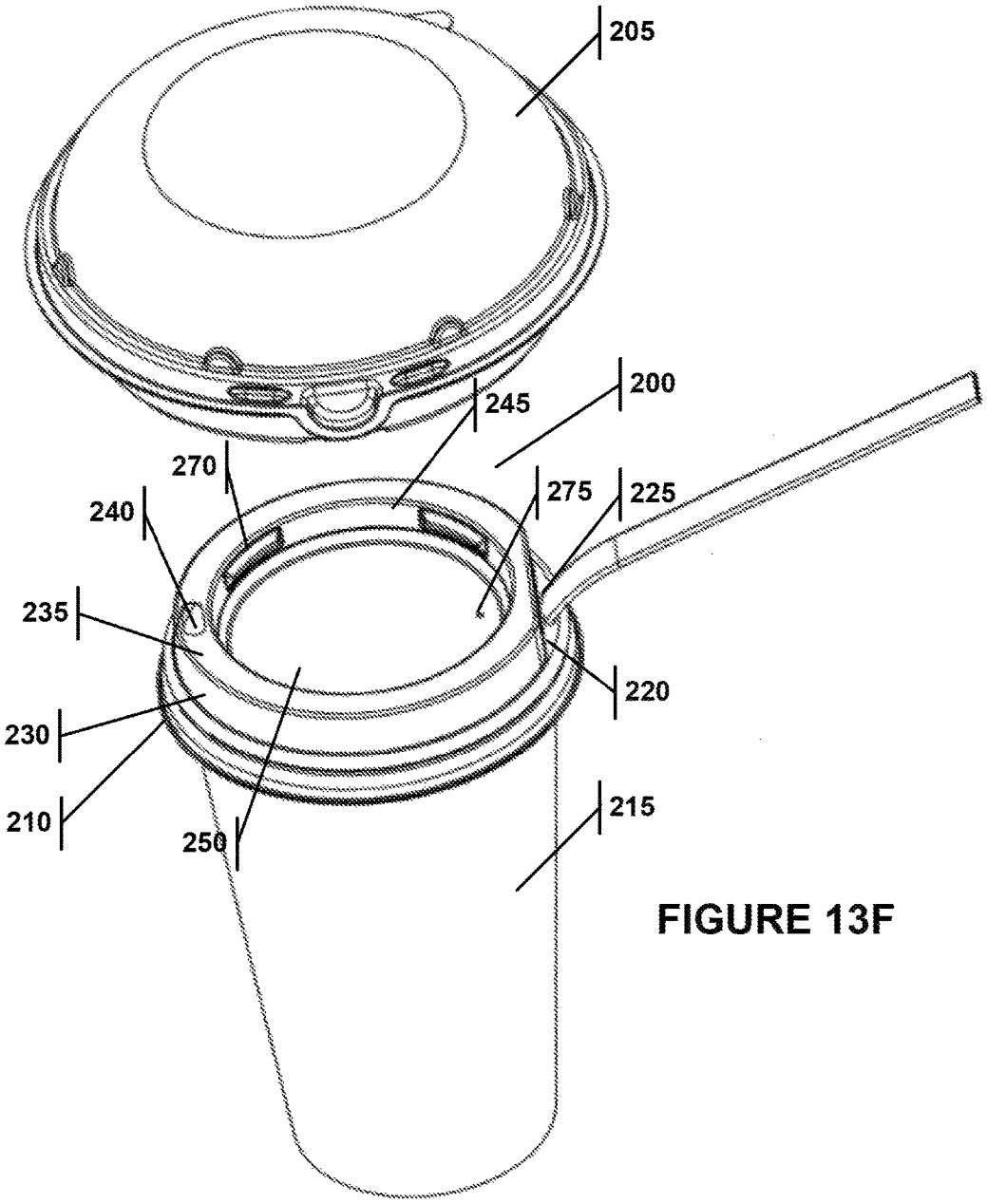
FIG. 13F is an isometric view of the beverage container/lid complex of FIG. 13A, with the food container detached from the lid of the beverage container.
Figure 13G:
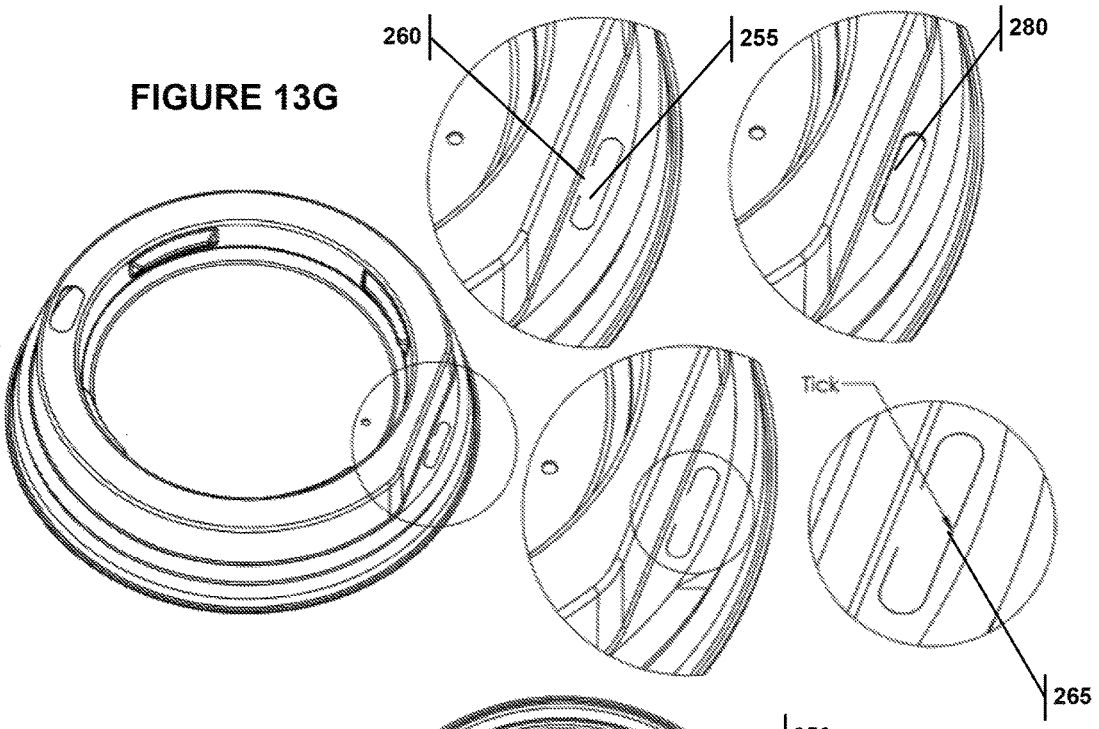
FIG. 13G is an isometric view of the beverage container lid of FIG. 13A, with the food container removed and without the beverage container and straw, showing the straw hole in detail.
Figure 13H:
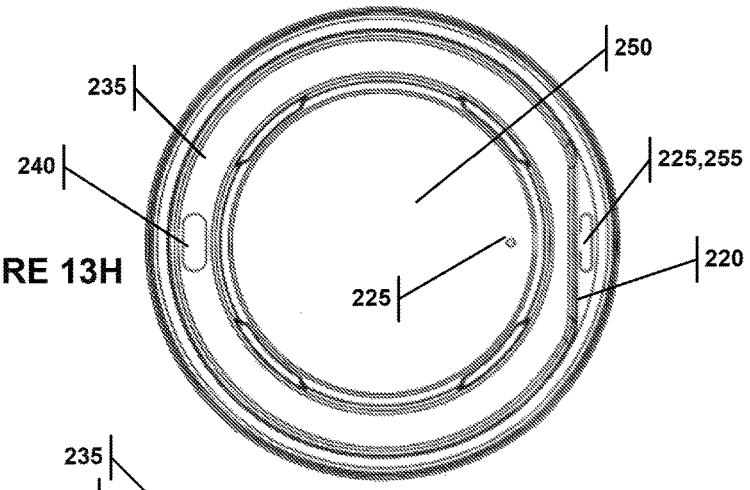
FIG. 13H is a top view of the lid of FIG. 13G.
Figure 13I:
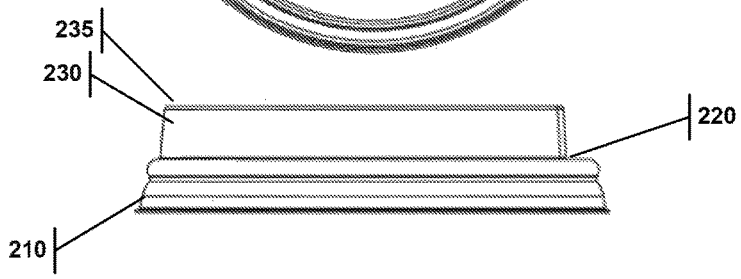
FIG. 13I is a side view of the lid of FIG. 13G.

One benefit of having the straw hole cover 255 is that a user may prefer to use the sip hole 240. If the straw hole 225 does not have a cover 255, and it is rather an open hole, the user may inadvertently spill the hot beverage while tilting the beverage cup during sipping from the sip hole 240. The straw hole cover 255 prevents this spillage. It further allows a retailer to use a single hot beverage lid for multiple users. Likewise as shown in FIG. 13B, when the food container 205 is coupled to the lid 200, the sip hole 240 is substantially covered by the food container 205, while the straw hole 225 is not covered by the food container 205. Thus, if the user prefers to use a straw and to consume the food from the food container 205, the beverage will not spill from the sip 240 when the food container 205 is coupled.

The straw may be constructed out of plastics, composites or other suitable materials. The straw may also be semi-rigid such that it returns to its original shape when it is not under a bending force.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend the following claims "and the embodiments in the specification to be strictly coextensive." Phillips v. AHW Corp., 415 F.3d 1303, 1323 (Fed. Cir. 2005) (en banc).

The invention claimed is:

1. A container lid that can be coupled to a food container, the lid comprising:

a continuous outer coupling trough for attachment to the open top of a beverage container, the trough circumscribing a footprint of the container lid;

a straw-hole planar surface within the footprint, the straw-hole planar surface adjacent to the outer coupling trough;

a hole for drinking a liquid in the container extending through the straw-hole planar surface;

a riser wall extending away from the straw-hole planar surface, the riser wall defining a first planar surface above the straw-hole planar surface, the first planar surface within the footprint;

a sip hole for drinking the liquid extending through the first planar surface; and a food container coupling wall connected to the first planar surface and extending from the first planar surface to a position lower than the first planar surface and a food container coupling bottom connected to the food container coupling wall.

2. The container lid of claim 1, wherein the straw-hole planar surface further comprises a straw-hole cover and a hinge, wherein the straw-hole cover rotates about the hinge and exposes the hole.

3. The container lid of claim 2, wherein the straw-hole cover further has a tick connected to the straw-hole planar surface.

4. The container lid of claim 1, the food container coupling wall comprising a pressure structure adapted to put pressure against the food container when a food container is coupled to the lid.

5. The container lid of claim 1, wherein the pressure is selected so as to allow the secure coupling of the food container to the lid; and to allow the decoupling of the food container from the lid.

6. The container lid of claim 1, further comprising a vent hole.

7. The container lid of claim 1, wherein the straw hole has a substantially rectangular shape with rounded corners.

8. The container lid of claim 1, wherein when a food container is coupled to the lid, the sip hole is substantially covered by the food container, while the straw hole is not covered by the food container.

* * * * *